US012496487B2

(12) United States Patent
Wu et al.

(10) Patent No.: US 12,496,487 B2
(45) Date of Patent: Dec. 16, 2025

(54) PLATE SQUEEZE CHEST PRESS

(71) Applicants: Bill M. Wu, Elk Grove, CA (US); Sam A. Wu, Elk Grove, CA (US)

(72) Inventors: Bill M. Wu, Elk Grove, CA (US); Sam A. Wu, Elk Grove, CA (US)

( * ) Notice: Subject to any disclaimer, the term of this patent is extended or adjusted under 35 U.S.C. 154(b) by 103 days.

(21) Appl. No.: 18/666,825

(22) Filed: May 17, 2024

(65) Prior Publication Data

US 2025/0352844 A1 Nov. 20, 2025

(51) Int. Cl.
*A63B 21/00* (2006.01)
*A63B 21/055* (2006.01)

(52) U.S. Cl.
CPC ..... *A63B 21/4033* (2015.10); *A63B 21/0552* (2013.01)

(58) Field of Classification Search
CPC . A63B 21/0004; A63B 21/04; A63B 21/0552; A63B 21/06; A63B 21/065; A63B 21/075; A63B 21/4023; A63B 21/4025; A63B 21/4033; A63B 21/4043
See application file for complete search history.

(56) References Cited

U.S. PATENT DOCUMENTS 5,498,223 A * 3/1996 Iams ..... A63B 21/1654 482/121
7,291,098 B1 * 11/2007 Krull ..... A63B 71/0036 482/107
10,188,899 B1 * 1/2019 Acuna, Jr. ..... A63B 21/0442
10,987,536 B2 * 4/2021 Popenhagen ..... A63B 21/065
2010/0029447 A1 * 2/2010 Song ..... A63B 21/06 482/93
2016/0016037 A1 * 1/2016 Chang ..... A63B 21/0722 482/141
2019/0282847 A1 * 9/2019 Acuna, Jr. ..... A63B 23/1218
2020/0147439 A1 * 5/2020 Acuna, Jr. ..... A63B 21/4035
2021/0283452 A1 * 9/2021 Chiang ..... A63B 21/0602
2024/0033566 A1 * 2/2024 Wilson ..... A63B 23/1281

FOREIGN PATENT DOCUMENTS

CN 111672057 A * 9/2020 ..... A63B 21/075
CN 216909036 U * 7/2022 ..... A63B 71/0036
KR 100789466 B1 * 1/2008 ..... A63B 21/0004
KR 101115444 B1 * 2/2012 ..... A63B 21/00065
WO WO-2023159816 A1 * 8/2023 ..... A63B 21/075

* cited by examiner

*Primary Examiner* — Gary D Urbiel Goldner
(74) *Attorney, Agent, or Firm* — Michelle C. Lau

(57) ABSTRACT

The plate squeeze chest press is a lightweight, portable exercise apparatus that is easily adjustable for a desired performance of exercises by any user, comprising a plate structure with opposable handles for grip control and a resistance band that is connectible to the plate structure through a slot configuration at a center of the plate structure. The slot configuration allows the resistance band to slide easily into the center of the plate structure and remain in position during the desired performance of the exercises. The plate structure may be of any geometrical shape and may be of solid or hollow construction, with the slot configuration sized to hold any desired number of resistance bands. The present invention enables a full-body workout that targets the middle and center chest line, upper chest, lower chest, side of chest, shoulders, rear delts, back, traps, abs, biceps, glutes, quads, hamstrings, and calves.

20 Claims, 9 Drawing Sheets

PLATE SQUEEZE CHEST PRESS

FIELD OF THE INVENTION

The present invention generally relates to an exercise apparatus for physical training. More specifically, the present invention relates to an exercise apparatus for developing or strengthening the muscles or joints of the body by working against a counterforce using elastic bands.

BACKGROUND OF THE INVENTION

Exercise enthusiasts join gyms in hopes of improving their health, strength, or physical appearance, either by improving their cardiovascular fitness, increasing lean muscle mass, or merely shedding a few pounds. However, it is difficult to get a full body workout at home or while traveling without a system of multi-functional exercise equipment. Such equipment is not readily portable and, once placed, is not easily movable due to the size and weight of the equipment. As such, the utility of exercise equipment is limited to the original designated stationary position.

The desirability of resistance exercise devices is inarguably high, as evidenced by the commercial success and variation of resistance exercise devices. These devices typically include elastic bands affixed to a type of anchor and including handles. Although such devices can perform a wide array of exercises and in some cases can simulate exercises performed on stationary exercise equipment, the anchor and handle configurations of commercially available resistance exercise devices limit the utility of the devices by restricting exercise positions, therein preventing a full body workout. The embodiments of the prior art, while providing multiple ways of performing exercises for the lower and upper parts of the body, are not able to target the center line of the upper torso pectoral region. Further, the prior art devices lack versatility of positioning for full body exercises due to the restricted anchoring and handle configurations.

There is a need for a resistance exercise device that can enable a full body workout without being dependent on a commercial gym or stationary home equipment, additionally allowing for portability to exercise at any desired location and flexibility in intensity and versatility depending on the individual user.

SUMMARY OF THE INVENTION

The present invention solves the afore-identified limitations of known resistance exercise devices by providing a lightweight, portable exercise apparatus that is easily adjustable for the desired performance of any user. The exercise apparatus comprises a plate structure with opposable handles for grip control and a resistance band that is connectible to the plate structure through a slot configuration at the center of the plate. The slot allows the resistance band to slide easily into the center of the plate and remain in position during performance of the exercises. The plate may be of any geometrical shape and may be of solid or hollow construction, with the slot sized to hold any desired number of resistance bands. The plate may also be configured with a timing device and biomechanical sensors on the outer surface of the plate. The present invention provides a lightweight, portable exercise device that enables a full-body workout, allowing the user to target the middle and center chest line, upper chest, lower chest, side of chest, shoulders, rear delts, back, traps, abs, biceps, glutes, quads, hamstrings, and calves.

BRIEF DESCRIPTION OF DRAWINGS

The present invention will become better understood with respect to the following descriptions, appended claims, and accompanying drawings where:

DESCRIPTION

Figure 1:
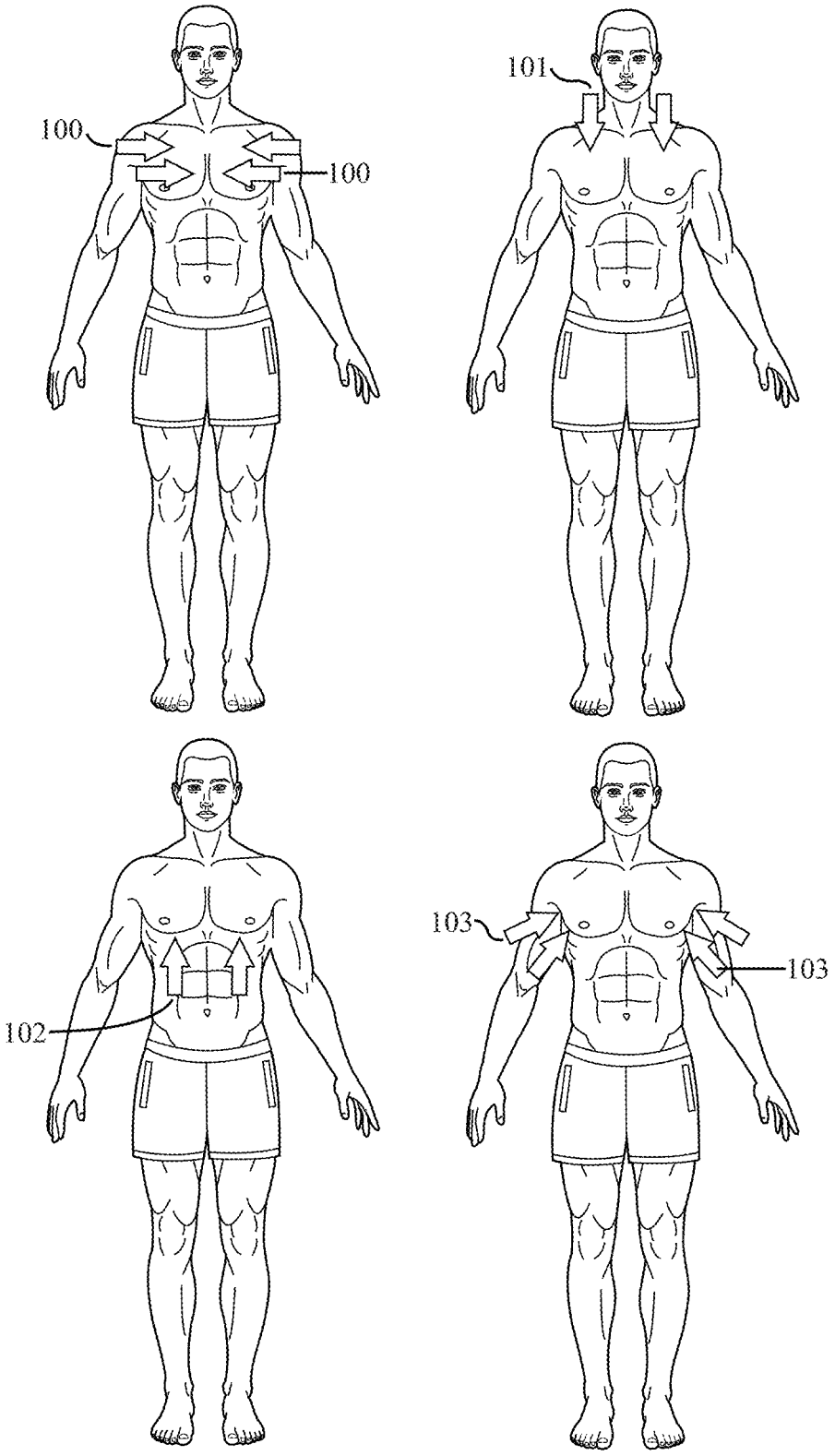
FIG. 1 illustrates the targeted areas of the chest.
Figure 2:
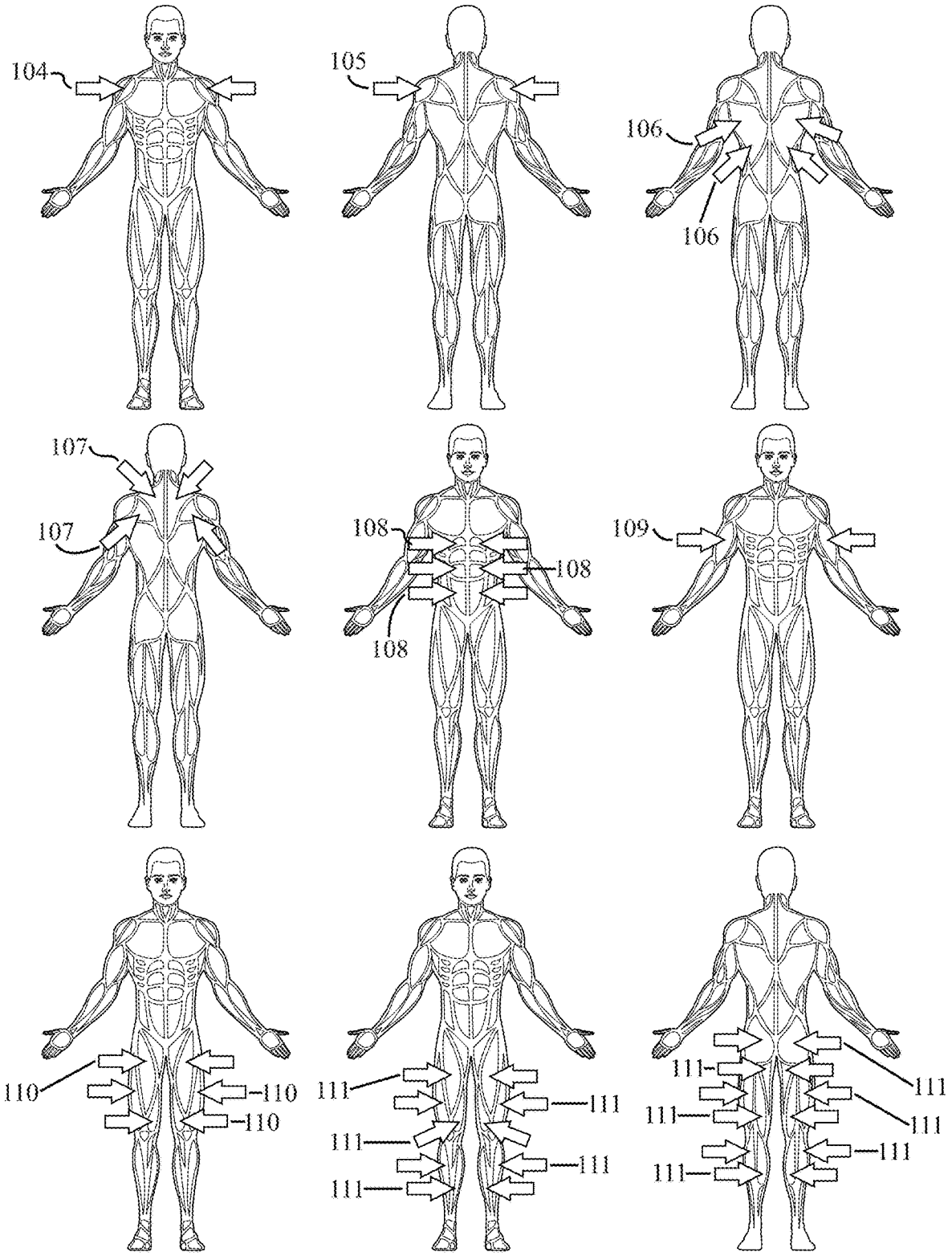
FIG. 2 illustrates the targeted areas of other parts of the body.

The plate squeeze chest press is designed to develop or strengthen the muscles or joints of the entire body providing results comparable to those attained using stationary gym equipment. The design of the plate squeeze chest press targets specific areas of the chest, arms, and legs to enable exercise movements that provide variable counterforce depending on the individual user. The plate squeeze chest press enables an individual user to focus on specific areas of the upper body as shown in FIG. 1. Specifically, the present invention is designed to target the middle and center chest line (100, FIG. 1), the upper chest (101, FIG. 1), the lower chest (102, FIG. 1), and the side of the chest (103, FIG. 1). In addition to the upper body, the present invention is also designed to provide a full body workout by enabling focus on other parts of the body as shown in FIG. 2. The plate squeeze chest press allows a user to work the shoulders (104, FIG. 2), rear delts (105, FIG. 2), back (106, FIG. 2), traps (107, FIG. 2), abs (108, FIG. 2), and biceps (109, FIG. 2), and also facilitates squats (110, FIG. 2) and leg extensions (111, FIG. 2) to work the hamstrings, glutes, quads, and calves.

Figure 3:
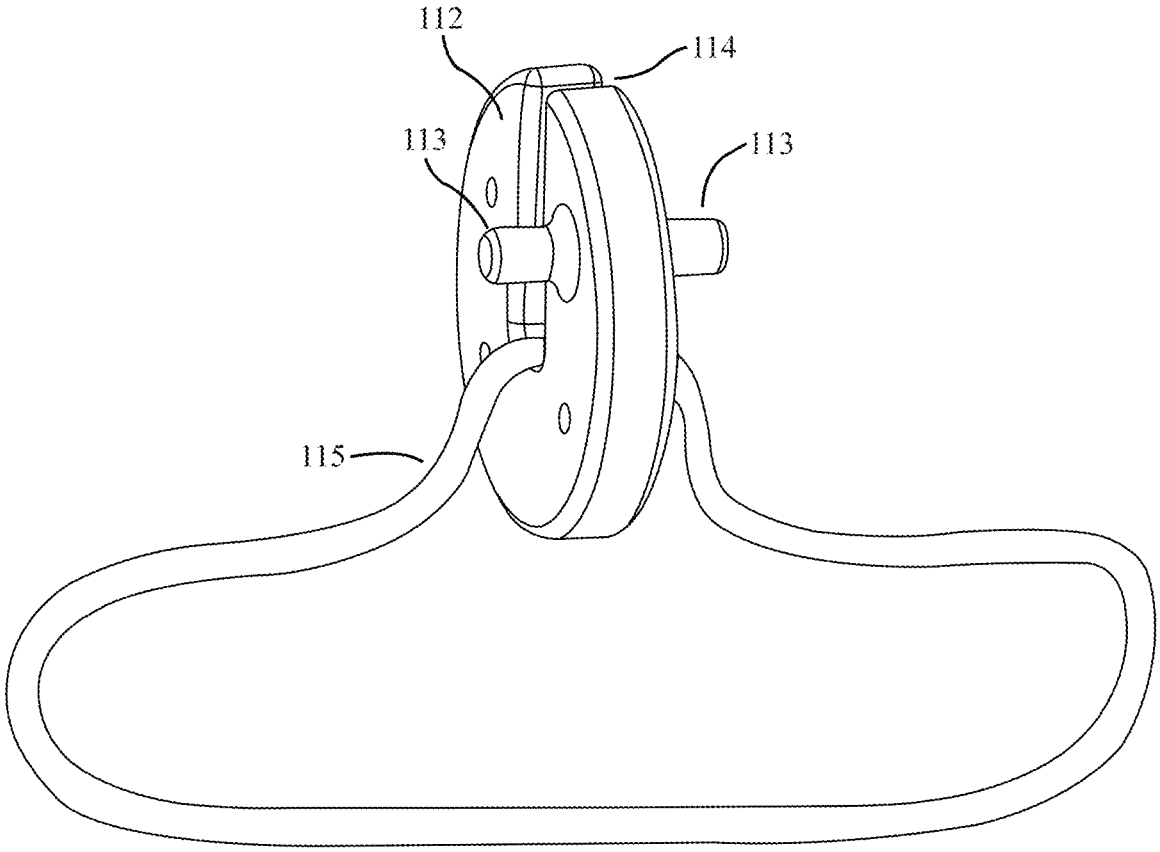
FIG. 3 illustrates a front view of the plate with an elastic band.
Figure 4:
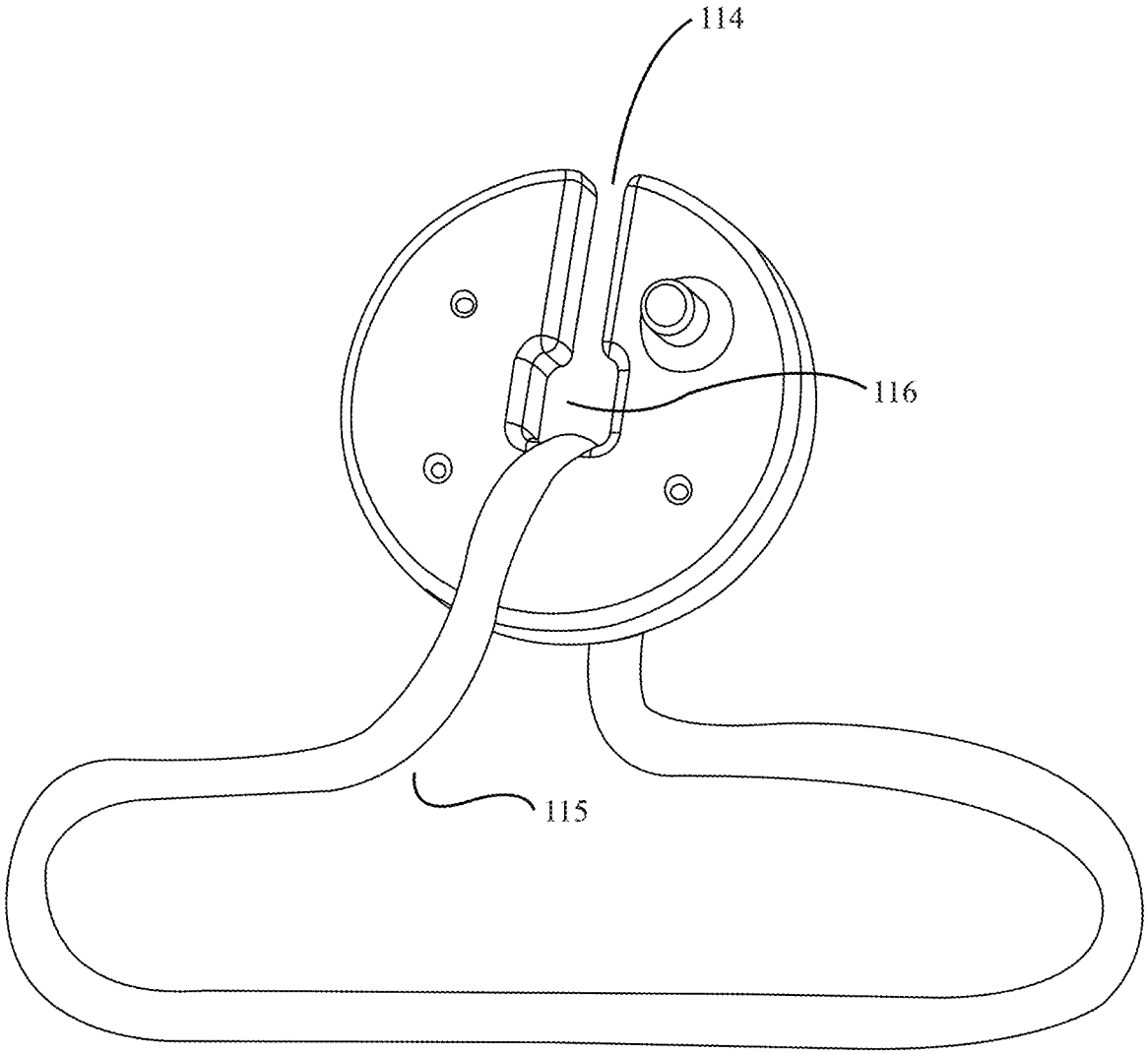
FIG. 4 illustrates a side view of the plate with an elastic band.

The plate squeeze chest press illustrated in FIG. 3 comprises a plate (112, FIG. 3) that can be of any geometrical shape with opposable rigid handles (113, FIG. 3) and a slot (114, FIG. 3) for containing an elastic resistance band (115, FIG. 3). As shown in FIG. 4, the slot (114, FIG. 4) extends from a peripheral edge of the plate and ends at the center of the plate, forming an orifice (116, FIG. 4) uniquely shaped to contain the resistance band (115, FIG. 4). Although the orifice can be any geometrical shape, the preferred embodiment for containment is square, as shown in FIG. 4. The slot allows for easy accessibility and positioning of the resistance band onto the center of the plate, while the orifice helps to contain the band during manipulation and exercise. The handles (113, FIG. 3) are shown as cylindrical prisms protruding from the outer sides of the plate to enable variations in gripping and positioning the plate. As an alternative to rigid handles, straps may also be used to facilitate maneuverability of the plate and can be securely mounted to the outer plate surfaces.

Figure 5:
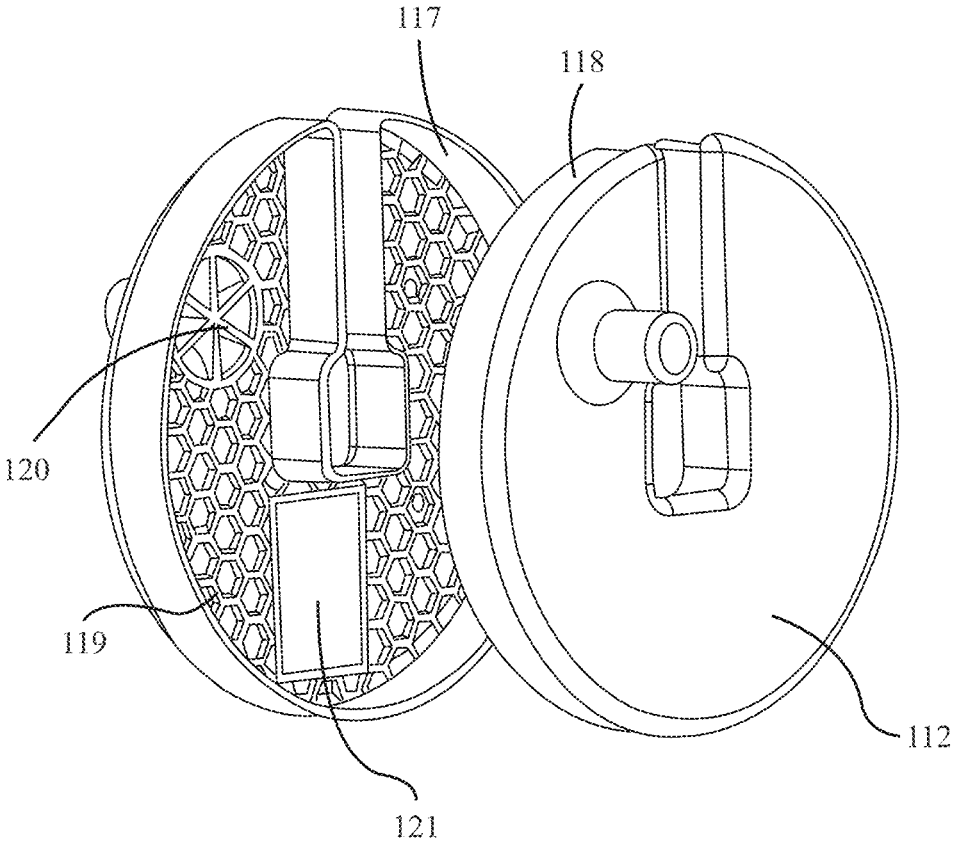
FIG. 5 illustrates an open view of a hollow plate.
Figure 6:
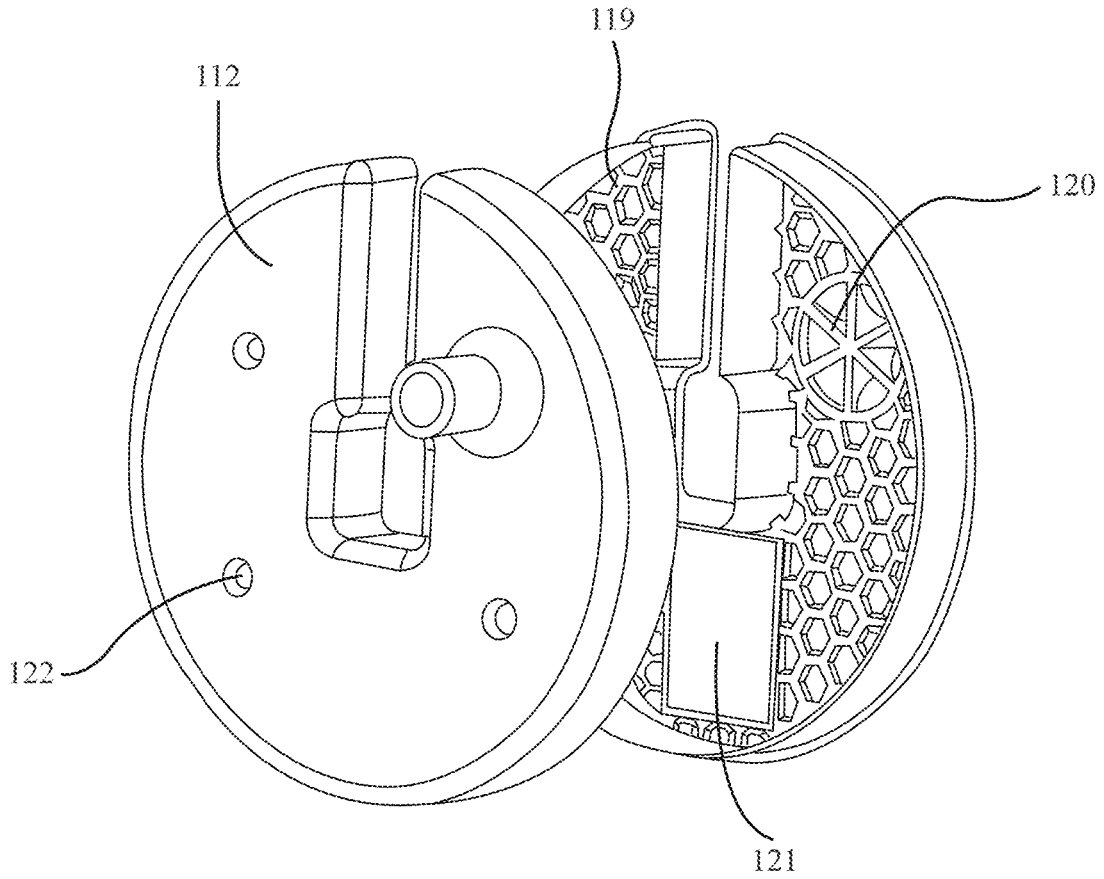
FIG. 6 illustrates an open view of a hollow plate with air apertures.

Although the plate may be of solid construction, the preferred embodiment of the plate is hollow to provide for a more lightweight apparatus and facilitate handling. As shown in FIG. 5, the hollow construction has an inner rim (118, FIG. 5) and an outer rim (117, FIG. 5) that securely close the plate (112, FIG. 5). To facilitate manufacture and design for strength, and depending on the composition of materials used for manufacture, the inner plate may be molded or shaped in a geometrical ribbing structure. The preferrable configuration is a honeycomb structure (119, FIG. 5). Additionally, to support the formation of the handles, the inner plate may comprise a structural webbing configuration (120, FIG. 5) that may be needed to stabilize the handles depending on the sizing and materials used in the composition. The inner plate may also comprise a designated area for insertion of marketing or instructional materials (121, FIG. 5). If the plate has a hollow configuration, apertures (122, FIG. 6) in the surface of the plate are necessary to allow for air flow to facilitate closure of the plate as shown in FIG. 6. The hollow configuration of the plate also serves as a container to house the resistance bands.

Figure 7:
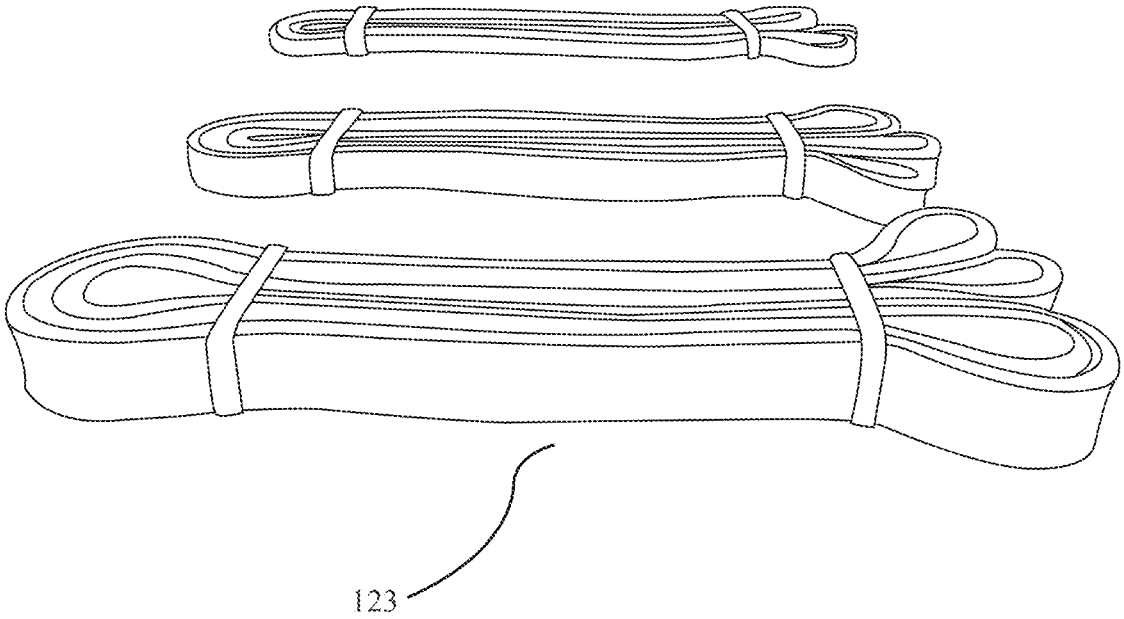
FIG. 7 illustrates various elastic bands.

FIG. 7 shows elastic resistance bands (123, FIG. 7) of various resistance weight classes and shapes. Shapes of the resistance bands may include tubular or solid, flat or round. The resistance bands are lightweight and, together with the plate, comprise a portable, ultra functional exercise apparatus.

Figure 8:
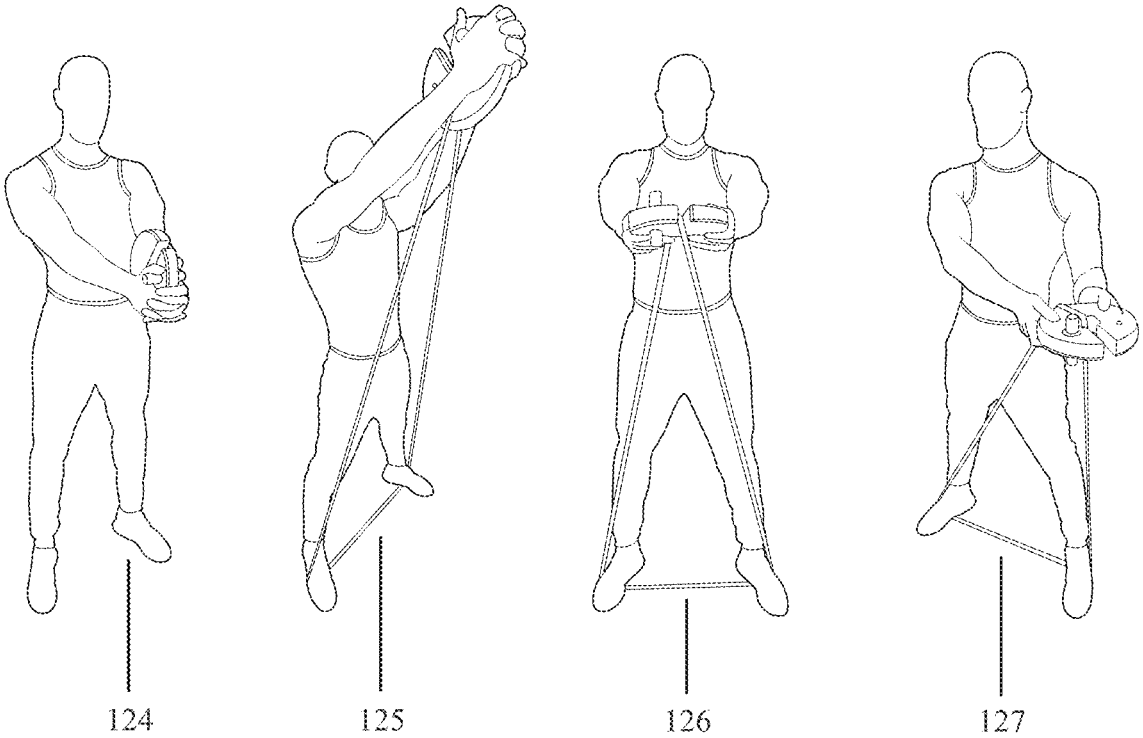
FIG. 8 illustrates the plate in use as grasped by a user.

As shown in FIG. 8, there are various ways of gripping the plate. The preferred geometrical shape of the plate is circular, which lends to a more comfortable resting position against the body and facilitates gripping at the edges (FIG. 8). The plate may be formed using any structurally sound materials, including plastic, polycarbonate, lightweight aluminum, wood, and any other material that can be cast or mold injected. The plate is preferably constructed of mold-injected polycarbonate material for structural integrity and durability of the device. The outer surface of the plate may be over-molded with a thin rubber or polymeric substance to create anti-slippage when palms are clasping both sides of the plate (FIG. 8).

Dimensions of the plate are not limited to one standard size. For portability and maneuverability, a diameter of ten inches or less is recommended. However, as the hands of a user vary in size, the diameter of the plate may also vary accordingly. Additionally, the plate can be used for exercise without the resistance bands, depending on the target area of the workout.

Figure 9:
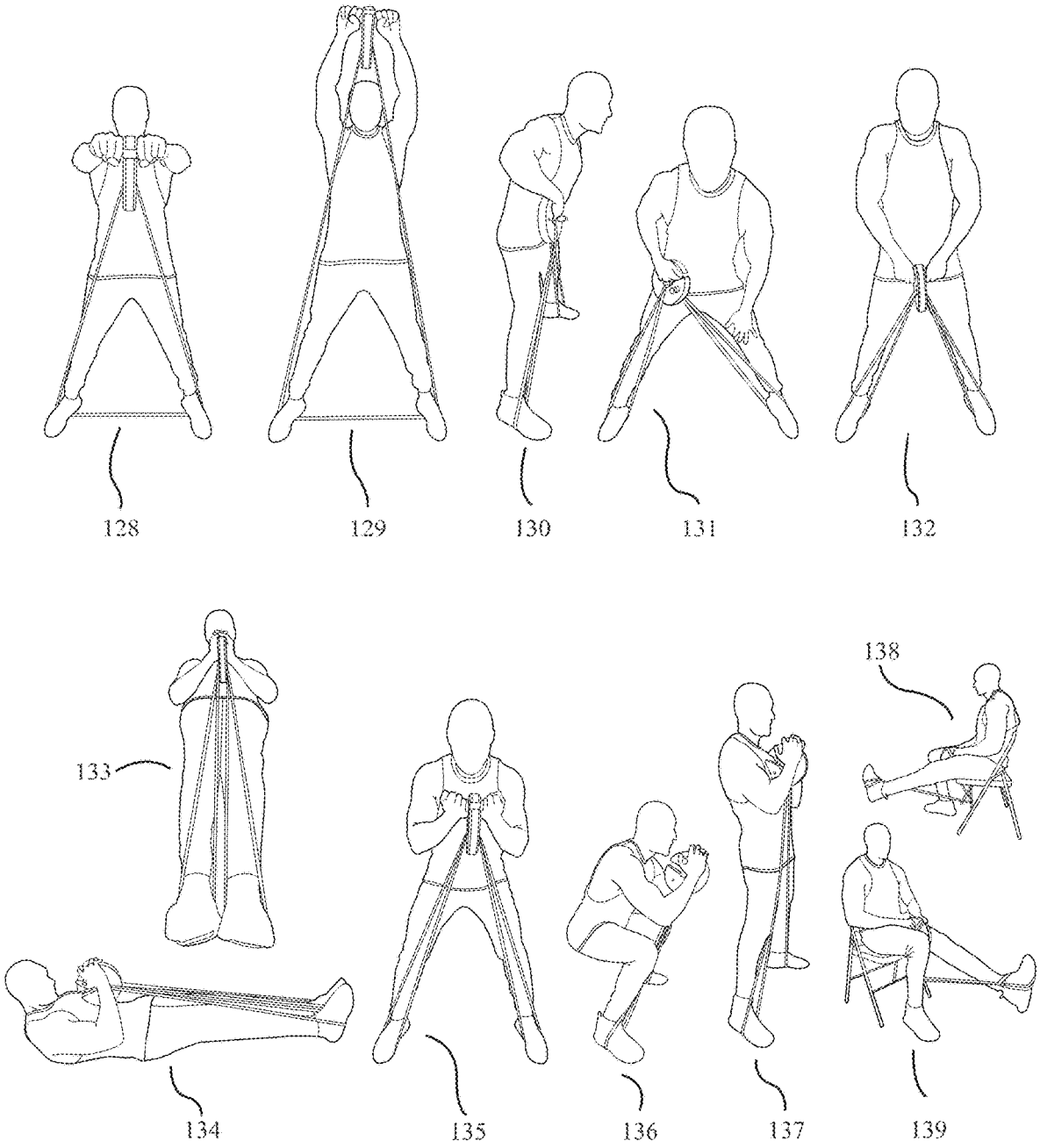
FIG. 9 illustrates the plate in use targeting various parts of the body.

FIGS. 8 and 9 show different types of exercises using the plate squeeze chest press to obtain a full body workout. For a middle chest line exercise, the plate is held with thumbs tucked behind the handles (124, FIG. 8). The fingers are interlocked, holding the plate with handles facing outwards and the slot slightly tilted forward. The user stands straight, then arches the back. The plate is moved at a downward angle away from the body to simulate a bench press movement. The arms are tucked to the side and then extended in a downright position not going below the waistline.

For an upper chest exercise, the plate is used in combination with at least one resistance band through the center of the plate and extending under and around both feet (125, FIG. 8). With the fingers interlocked and gripping the edge of the plate, the user brings the plate to the chest level at a resting position. Standing up straight, arching the back, arms and elbows tucked to the side, the user pushes the plate outward at an upper angle above the head, then returns the plate to the resting position at the chest.

For a lower chest exercise, the plate is used in combination with at least one resistance band through the center of the plate and extending around both feet. With the resting position of the plate at the groin level, the user raises the plate outward to the shoulder level (126, FIG. 8), then returns to the resting position of minimal resistance.

For a side of chest exercise, the plate is used in combination with at least one resistance band through the center of the plate and extending around both feet. With the resting position of the plate at the waist level, the user pushes the plate to one side of the waist (127, FIG. 8), then returns to the resting position of minimal resistance.

For a shoulder exercise, the plate is used in combination with at least one resistance band through the center of the plate and extending around both feet. Gripping both handles with the resting position of the plate at the groin level, the user extends the plate outward to the shoulder level (128, FIG. 9), then above the head for a full extension (129, FIG. 9), returning to the resting position at the groin level.

For a rear delts exercise, the plate is used in combination with at least one resistance band through the center of the plate. The user steps on one end of the band with each foot and passes both straps of the band through the center orifice of the plate. Grabbing one handle with one hand, the user pulls the plate back to one side at an upward angle (130, FIG. 9), then returns to the resting position of minimal resistance.

For a back exercise, the plate is used in combination with at least one resistance band through the center of the plate. The user steps on one end of the band with each foot and passes both straps of the band through the center orifice of the plate. Grabbing the slot with one hand for use as a handle, the user pulls back on the plate (131, FIG. 9), then returns to the resting position of minimal resistance.

For a traps exercise, the plate is used in combination with at least one resistance band through the center of the plate. The user steps on one end of the band with each foot and passes both straps of the band through the center orifice of the plate. Grabbing both handles, the user pulls up on the handles to bring the plate upward to an elevated position (132, FIG. 9), then returns to the resting position of minimal resistance.

For an abs exercise, the plate is used in combination with at least one resistance band through the center of the plate. The user is in a supine position with one end of the band under each foot and both straps of the band through the center orifice of the plate (133, FIG. 9). With the handles secured between the thumbs and the index fingers, the user pulls the plate up to the chest line and raises the body slightly upward while squeezing the abs (134, FIG. 9), then returns to the resting position of minimal resistance.

For a biceps exercise, the plate is used in combination with at least one resistance band through the center of the plate. The user steps on one end of the band with each foot and passes both straps of the band through the center orifice of the plate. With the palms facing upwards, the user grabs the handles with the outer ends of the hands, then performs an upward curl motion with the plate (135, FIG. 9), returning to the resting position of minimal resistance.

For a squats exercise, the plate is used in combination with at least one resistance band through the center of the plate. The user steps on one end of the band with each foot and passes both straps of the band through the center orifice of the plate. Grabbing the plate with palms and interlocking the fingers about the plate edge, the user positions the plate at the upper chest and squats down to a 90-degree angle while maintaining the position of the plate at the upper chest (136, FIG. 9), returning to the standing position of minimal resistance (137, FIG. 9).

For a leg extension exercise, the plate is used in combination with at least one resistance band through the center of the plate. From a seated position, the user steps on one end of the resistance band and pulls the opposite end of the band through the loop of the other end of the band (139, FIG. 9).

The user positions the resistance band around a chair leg, pulls the band through the plate slot, and secures the end of the band onto the handle of the plate. With the plate positioned straight up and between the legs, the user grasps both handles and extends the leg, adjusting for desired resistance.

As illustrated, the plate squeeze chest press enables a full body workout of all muscle groups. Resistance bands may be stacked to provide variable intensities and adjustments of resistance. The plate may also be configured with a timing device and biomechanical sensors on the outer surface of the plate. In addition to the convenience of enabling a full body workout, gym enthusiasts will appreciate the simplicity of the lightweight, portable, and compact design that is user friendly and easy to bring along to any destination where finding a full gym may be challenging or impractical. The plate squeeze chest press is equivalent to having a gym in a bag.

The invention claimed is:

1. A portable exercise apparatus comprising:

a plate structure having a peripheral edge, a first side, a second side, and a center, wherein said plate structure is configured with an open slot extending from said peripheral edge through said plate structure and terminating at an orifice located at said center of said plate structure;

a pair of opposable handles integral to said plate structure with a first handle of said pair of opposable handles positioned on said first side of said plate structure and a second handle of said pair of opposable handles positioned on said second side of said plate structure; and an elastic resistance band, wherein said elastic resistance band forms a closed loop and passes through said orifice at said center of said plate structure.

2. The portable exercise apparatus as in claim 1, wherein said plate structure is circular.

3. The portable exercise apparatus as in claim 1, wherein said orifice is square-shaped.

4. The portable exercise apparatus as in claim 1, wherein said pair of opposable handles are rigid.

5. The portable exercise apparatus as in claim 1, wherein said pair of opposable handles are cylindrical.

6. The portable exercise apparatus as in claim 5, wherein said pair of opposable handles are supported by a strengthening webbing configuration located where said pair of opposable handles are integral to said plate structure.

7. The portable exercise apparatus as in claim 1, wherein said pair of opposable handles are flexible loops or straps.

8. The portable exercise apparatus as in claim 1, wherein said plate structure is hollow, wherein said first side is detachable from said second side, said first side comprising an outer rim and said second side comprising an inner rim, and wherein said outer rim and said inner rim slide together in contact upon closure of said plate structure.

9. The portable exercise apparatus as in claim 8, wherein either said first side or said second side is configured to contain at least one air aperture to facilitate closure of said plate structure.

10. The portable exercise apparatus as in claim 9, wherein a portion of said inner side of said first side or said second side comprises a smooth area to facilitate placement of instructions or marketing materials.

11. The portable exercise apparatus as in claim 9, wherein said plate structure comprises an interior portion to house said elastic resistance band.

12. The portable exercise apparatus as in claim 1, wherein said plate structure is filled with a type of foam.

13. The portable exercise apparatus as in claim 1, wherein said elastic resistance band comprises two or more elastic resistance bands.

14. A portable exercise apparatus comprising:

a circular plate structure having a peripheral edge, a first side, a second side, and a center, wherein said circular plate structure is configured with an open slot extending from said peripheral edge through said circular plate structure and terminating at a square-shaped orifice located at said center of said circular plate structure;

a pair of opposable cylindrical handles integral to said circular plate structure with a first handle of said pair of opposable cylindrical handles positioned on said first side of said circular plate structure and a second handle of said pair of opposable cylindrical handles positioned on said second side of said circular plate structure; and an elastic resistance band, wherein said elastic resistance band forms a closed loop and passes through said square-shaped orifice at said center of said circular plate structure.

15. The portable exercise apparatus as in claim 14, wherein said circular plate structure is hollow, wherein said first side is detachable from said second side, said first side comprising an outer rim and said second side comprising an inner rim, and wherein said outer rim and said inner rim slide together in contact upon closure of said circular plate structure.

16. The portable exercise apparatus as in claim 15, wherein either said first side or said second side is configured to contain at least one air aperture to facilitate closure of said circular plate structure.

17. The portable exercise apparatus as in claim 16, wherein said circular plate structure additionally comprises a timing device.

18. The portable exercise apparatus as in claim 16, wherein said circular plate structure additionally comprises at least one biomechanical sensor.

19. The portable exercise apparatus as in claim 15, wherein at least one side of either said first side or said second side comprises an over-mold outside layer of protective material.

20. The portable exercise apparatus as in claim 15, wherein an inner side of said first side or said second side comprises structurally strengthening ribbing.

* * * * *